US006062369A

United States Patent [19]

Negishi

[11] Patent Number: 6,062,369

[45] Date of Patent: May 16, 2000

[54] AUTOMATIC BILL ACCEPTING APPARATUS AND METHOD OF DETECTING SKEWED BILL THAT IS INSERTED TO THE APPARATUS

[75] Inventor: Hiroyuki Negishi, Isesaki, Japan

[73] Assignee: Sanden Corp., Isesaki, Japan

[21] Appl. No.: 09/076,223

[22] Filed: May 12, 1998

[30] Foreign Application Priority Data

May 30, 1997 [JP] Japan ..... 9-157934

[51] Int. Cl.[7] ..... B65H 7/14; G07D 7/00

[52] U.S. Cl. ..... 194/207; 271/227

[58] Field of Search ..... 194/207; 271/227, 271/228

[56] References Cited

U.S. PATENT DOCUMENTS

| | | | |
|---|---|---|---|
| 4,163,157 | 7/1979 | Guignard et al. | 250/561 |
| 4,487,306 | 12/1984 | Nao et al. | 194/207 |
| 4,741,526 | 5/1988 | Reed | 271/261 |
| 4,944,505 | 7/1990 | Sherman, III | 271/265 |

FOREIGN PATENT DOCUMENTS

| | | | |
|---|---|---|---|
| 0280147 | 8/1988 | European Pat. Off. | G07D 1/00 |
| 4-264997 | 9/1992 | Japan . | |
| 2129126 | 5/1984 | United Kingdom | G01B 11/04 |

*Primary Examiner*—F. J. Bartuska
*Attorney, Agent, or Firm*—Kenjiro Hidaka

[57] ABSTRACT

A bill accepting apparatus has a pair of photo-electronic sensors disposed spaced apart from each other on an imaginary line orthogonal to a bill transport direction. The leading edge of the bill being transported is detected at times $T_1$ and $T_2$ by the respective sensors. A time difference between $T_1$ and $T_2$ is compared with a predetermined value. From a known distance between the two sensors, a known bill transport speed and the time difference, the tilt angle of the leading edge can be determined. Analog outputs hyof the sensors are individually converted at a given frequency to first and second series of digital values. A CPU interrupt signal is obtained each time when both of each of the first and second series of digital values are obtained, and this interrupt signal initiates a skewed bill detecting task in a CPU. The time difference between $T_1$ and $T_2$ is obtained by counting a number of the interrupt signal therebetween, and the bill is determined to be skewed if the counted number is greater than a predetermined number. The outputs of the sensors are also utilized for identifying and verifying the bill.

3 Claims, 5 Drawing Sheets

41
42
43
44
45
46
47
48
49
50
51
51m
51s
T1
T2
TAD
150µs
150µs
150µs
FF
FF
FF

AUTOMATIC BILL ACCEPTING APPARATUS AND METHOD OF DETECTING SKEWED BILL THAT IS INSERTED TO THE APPARATUS

BACKGROUND OF THE INVENTION

1. Field of the Invention

This invention pertains to an automatic bill accepting apparatus and a method of detecting a skewed bill (i.e. bank note) that is inserted to the apparatus. The apparatus is typically used in an automatic commodity vending machine, an automatic ticket issuing machine, or an automatic money exchanging machine.

2. Description of the Prior Art

A conventional automatic bill accepting apparatus used in an automatic commodity vending machine etc. has a bill inlet port, a bill transport path and a bill transport mechanism. The bill inserted through the inlet port is transported in the transport path in a predetermined direction. The bill accepting apparatus normally has a bill identification and verification means, typically of a photo-electronic type, that identifies denomination of the bill and verifies its genuineness.

One of the serious problems pertaining to a bill accepting apparatus is skewing or jamming of a bill. Such skewing or jamming problem occurs when the bill is inserted to the inlet port in a skewed state or bill transport rollers in a bill transport mechanism apply uneven pressures onto the bill. Naturally, the bill will not be correctly identified or verified when it is skewed or jammed in the apparatus.

The Japanese laid-open patent application, laid-open no. 4-264997, dated Sep. 21, 1992, discloses an automatic bill accepting apparatus having a pair of first and second photo-electronic bill inlet sensors disposed on an imaginary line that is orthogonal to the bill transport direction in the bill transport path and close to the bill inlet port. These two sensors are disposed close to respective side ends of the bill transport path. A photo-electronic bill recognition sensor, which is the third sensor, is disposed further inside of the bill transport path. A bill is detected by the first and/or the second sensor as soon as the bill is inserted to the bill inlet port. The bill is identified and verified by the third sensor after it has been advanced in the bill transport path.

The Japanese patent publication further discloses a method of detecting a skewed bill. According to the method, an elapsed time after the third sensor detects the leading edge of the bill until either the first sensor or the second sensor first detects the trailing edge of the bill is measured. If the bill is skewed, the measured elapsed time will be smaller than the comparable elapsed time when the bill is being transported without a skew. The measured elapsed time is compared with a predetermined value, and if the measured time is smaller than the predetermined value, it is determined that the bill is skewed and the bill transport rollers are driven in reverse to return the bill.

In the above mentioned conventional method of detecting a skewed bill by measuring the elapsed time from the instance the leading edge of the bill reaches the bill recognition sensor until its trailing edge reaches one of the bill inlet sensors, any fluctuation of power source voltage or change of ambient temperature, or aging of the bill transport mechanism, which causes a change of frictional loss in the transport mechanism, tends to cause variation of bill transport speed. This adversely affects the accuracy of the measurement of the elapsed time. Furthermore, by the time the trailing edge of the bill reaches one of the bill inlet sensors, the bill may have already jammed in the bill transport path and, therefore, it may be too late to return the bill by driving the bill transport rollers in reverse.

SUMMARY OF THE INVENTION

In view of the above discussed situation, the primary object of the present invention is to provide an automatic bill accepting apparatus and method of detecting a skewed bill that is inserted to the apparatus, in which a skewed bill is reliably detected at an early time after the bill is inserted to the apparatus.

The second object of the present invention is to detect a skewed bill using bill sensors that are also utilized for identifying and verifying the bill.

The third object of the present invention is that the maximum allowable skew angle can be adjusted, if necessary, without modifying the hardware.

In order to achieve the above objects, the bill accepting apparatus according to the present invention has a bill inlet port, a bill transport path, a bill transport mechanism, a first bill sensor, a second bill sensor, and a third bill sensor.

The first bill sensor is disposed in the bill transport path in a proximity of the bill inlet port. This sensor detects a bill inserted through the inlet port and causes to start driving the bill transport mechanism. The second and the third bill sensors are disposed further downstream in the bill transport path spaced apart from each other on an imaginary line that is orthogonal to the bill transport direction. When the bill advances in the bill transport path with its leading edge angled to the imaginary line orthogonal to the bill transport direction, the leading edge of the bill will reach the second and the third sensors at different times, $T_1$ and $T_2$. The time difference between $T_1$ and $T_2$ signifies the tilt angle of the leading edge, or the extent of the skew of the bill. The time difference between $T_1$ and $T_2$ is determined in a digital arithmetic operation in a CPU that also performs the task of identifying and verifying the bill.

Analog outputs of the second and the third sensors are individually converted by AD converters at a given sampling frequency to respective digital signals signifying series of digital values. Each of the digital values of both the digital signals are sequentially compared with a criterion value in a CPU according to a given program and it is determined that the leading edge of the bill has reached the corresponding bill sensor when any digital value is smaller than the criterion value. Thus, timings $T_1$ and $T_2$ are individually determined when the leading edge of the bill reaches the respective bill sensors.

On the other hand, each of the AD converters outputs, besides the above mentioned digital signals, an AD conversion completion signal each time AD conversion is completed. Further, an interrupt signal is obtained each time both the AD converters complete AD conversions, thereby outputting both the AD conversion completion signals. The interrupt signal continually interrupts a main task performed by a CPU for identifying and verifying the bill. The number of the continual interrupt signal is counted in the CPU between the timings $T_1$ and $T_2$. Since the period of the continually transmitted interrupt signal is equal to the period of the sampling signal, which is predetermined, the period multiplied by the counted number of the interrupt signal equals the elapsed time between the timings $T_1$ and $T_2$. The counted number of the interrupt signal is compared with a predetermined number in the CPU and the bill is determined to be skewed if the counted number exceeds the predetermined number according to the program.

DETAILED DESCRIPTION OF THE PREFERRED EMBODIMENTS

The present invention will now be described in detail in reference to the drawings.

Figure 1:
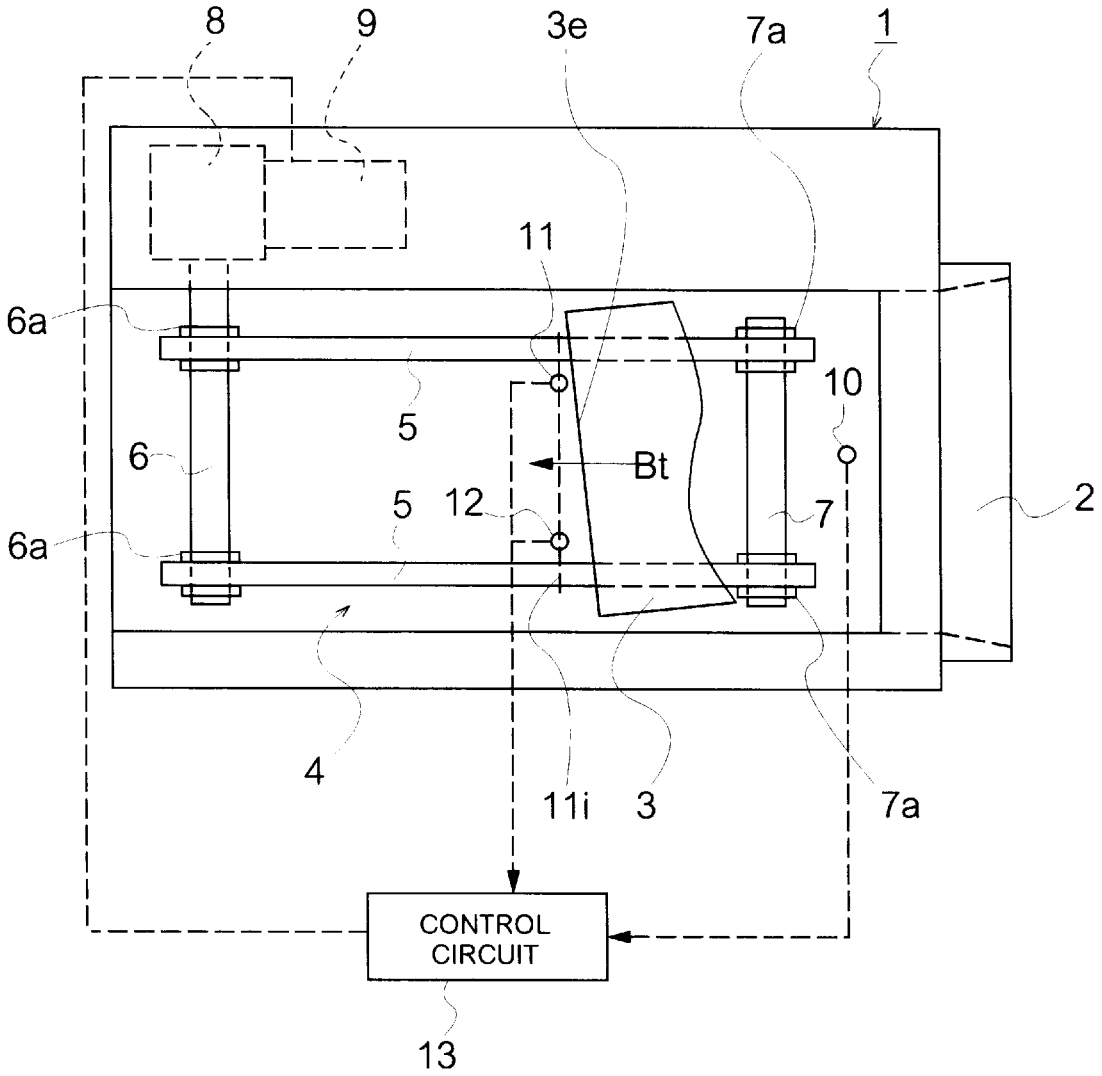
FIG. 1 is a plan view of an automatic bill accepting apparatus according to the present invention.
Figure 2:
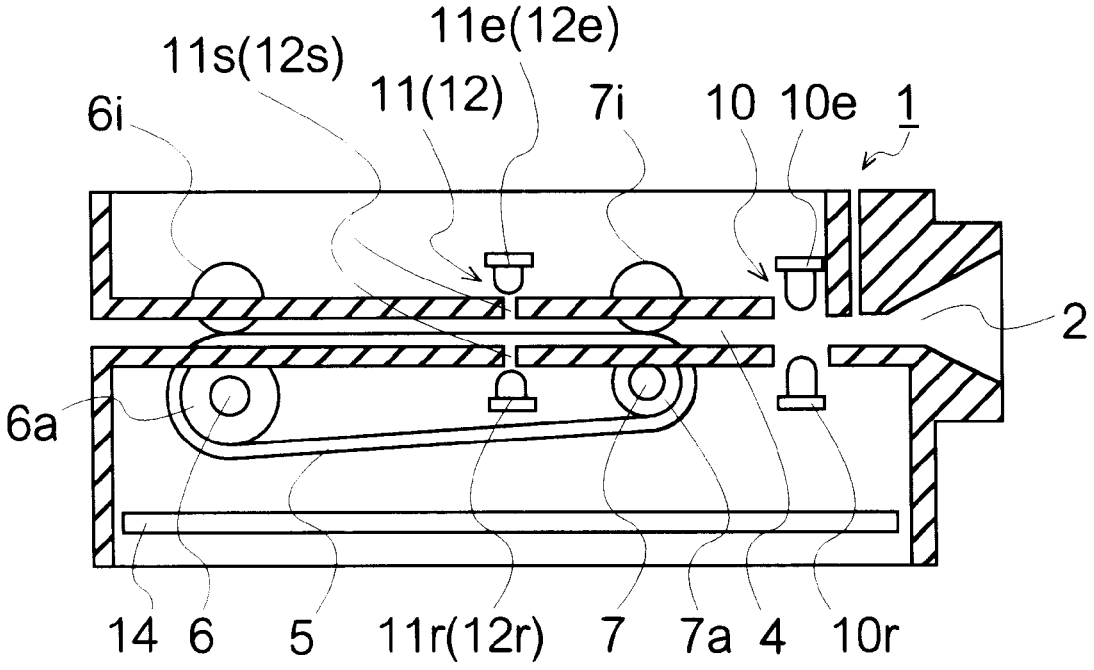
FIG. 2 is a side sectional view of the apparatus shown in FIG. 1.

Referring to FIGS. 1 and 2, an automatic bill accepting apparatus 1 of the present invention has a bill inlet port 2, a bill transport path 4, a pair of endless belts 5 that horizontally run over the driving pulleys 6*a* and driven pulleys 7*a* that are fixedly mounted on driving shaft 6 and driven shaft 7, respectively, and idler pinch rollers 6*i*, 7*i*. The driving shaft 6 is drivably connected to a bi-directional motor 9 by way of a gear unit 8.

The apparatus 1 further has a sensor 10, a sensor 11, a sensor 12, an electronic control circuit 13, and a circuit board 14 on which the control circuit 13 is mounted.

The direction indicated by arrow Bt in FIG. 1 signifies the bill transport direction. The sensor 10 is disposed in the bill transport path 4 at a laterally middle part with respect to the bill transport direction Bt near the bill inlet port 2. The sensors 11 and 12 are disposed in the bill transport path 4, spaced apart from each other on an imaginary line lli that is orthogonal to the bill transport direction Bt at a position downstream from the sensor 10. In FIG. 1, the leading edge 3*e* of the bill 3 is shown angled with respect to the line 11*i*, having just reached the sensor 11 but not the sensor 12.

Referring particularly to FIG. 2, all of the sensors 10, 11, and 12 are of photo-electronic type having a light emitter 10*e* and a light receiver 10*r*, a light emitter 11*e* and a light receiver 11*r*, and a light emitter 12*e* and a light receiver 12*r*, respectively. Between the light emitter 11*e* and the light receiver 11*r* and between the light emitter 12*e* and the light receiver 12*r* are disposed light path limiting slits 11*s* and 12*s*, respectively. In the present embodiment, the dimensions of each of the slits 11*s*, 12*s* are 0.5 mm in the bill transport direction and 2.0–3.0 mm in the direction orthogonal thereto. The use of the slits 11*s*, 12*s* is intended for obtaining high resolution photo-electronic readings of the leading edge 3*e* and the print pattern of the bill 3 for not only reliably detecting any skewed bill but also accurately identifying and verifying the bill 3.

The sensor 10 is used for detecting the leading edge 3*e* of the bill 3 to cause the bill transport motor 9 to be driven so that the bill 3 is taken into the apparatus 1 by the bill transport mechanism. Since this feature is conventional and not substantially related with the present invention, the function pertaining to the sensor 10 will not be discussed in detail. The sensors 11 and 12 are utilized not only for detecting any skewed bill but also for identifying the denomination of the bill 3 and verifying its genuineness. However, since the bill identification and verification functions per se are not necessarily a main object of the present invention, details of the functions will not be discussed here. The discussion hereunder will, therefore, be made pertaining to the method of detecting a skewed bill that is inserted to the apparatus 1, which is the primary object of the present invention.

Figure 3:
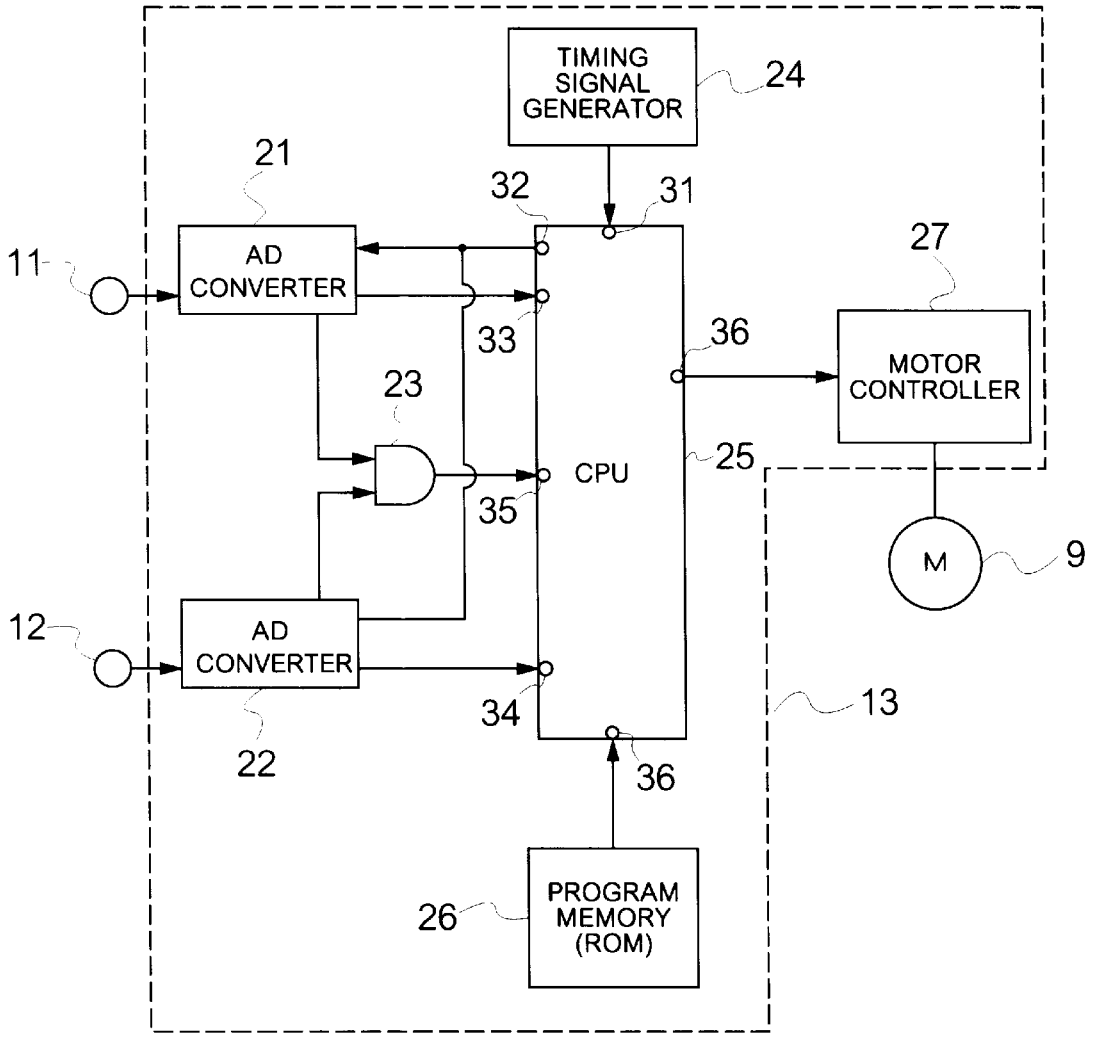
FIG. 3 is a block diagram of a control circuit used in the apparatus shown in FIG. 1.

FIG. 3 is a block diagram of the control circuit 13 used in the apparatus 1 in connection with the sensors 11, 12, and FIGS. 4A–4K are timing charts to explain the function of the method for detecting a skewed bill that is inserted to the apparatus 1.

In reference to FIG. 3, the control circuit 13 includes an AD (analog-digital) converter 21, an AD converter 22, an AND gate 23, a timing signal generator 24, a central processing unit (CPU) 25, a program memory (ROM) 26, and motor controller 27. The CPU 25 includes a timing signal input port 31, a sampling signal output port 32, a first digital value signal input port 33, a second digital value signal input port 34, an interrupt signal input port 35, and a motor control signal output port 36.

Figure 4:
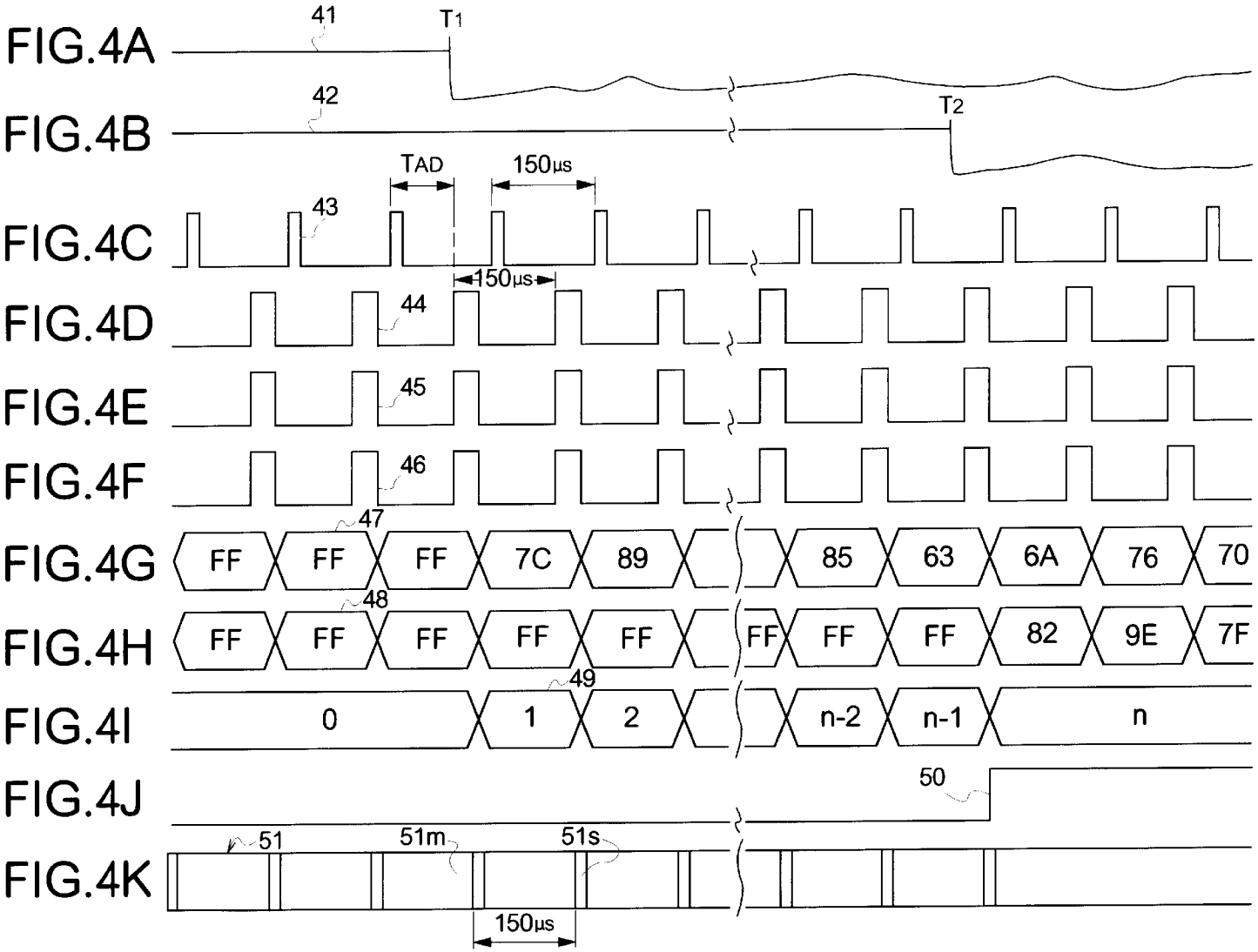
FIGS. 4A to 4K are timing charts for explaining the function for detecting a skewed bill by the apparatus shown in FIGS. 1, 2.

Reference should now be made also to FIG. 3. FIG. 4A is a first analog signal 41 outputted from the sensor 11. FIG. 4B is a second analog signal 42 outputted from the sensor 12. FIG. 4C is a sampling signal 43 transmitted from the CPU 25 through the output port 32 and inputted to both the AD converters 21 and 22. FIG. 4D is a first AD conversion completion signal 44 outputted from the AD converter 21. FIG. 4E is a second AD conversion completion signal 45 outputted from the second AD converter 22. FIG. 4F is a series of interrupt signals 46 outputted from the AND gate 23 and inputted to the CPU 25 through the interrupt signal input port 35. FIG. 4G is a first digital value signal 47 outputted from the AD converter 21 and inputted to the CPU 25 through the input port 33. FIG. 4H is a second digital value signal 48 outputted from the AD converter 22 and inputted to the CPU 25 through the input port 34. FIG. 4I is a series of numbers, each representing an increased elapsed time, that are sequentially counted in the CPU 25, as will be explained in detail later. FIG. 4J shows a motor reverse signal 50 outputted from the CPU 25 through the output port 36 and inputted to the motor controller 27. FIG. 4K is a task diagram 51 of the CPU 25, which will be discussed in detail later.

Figure 5:
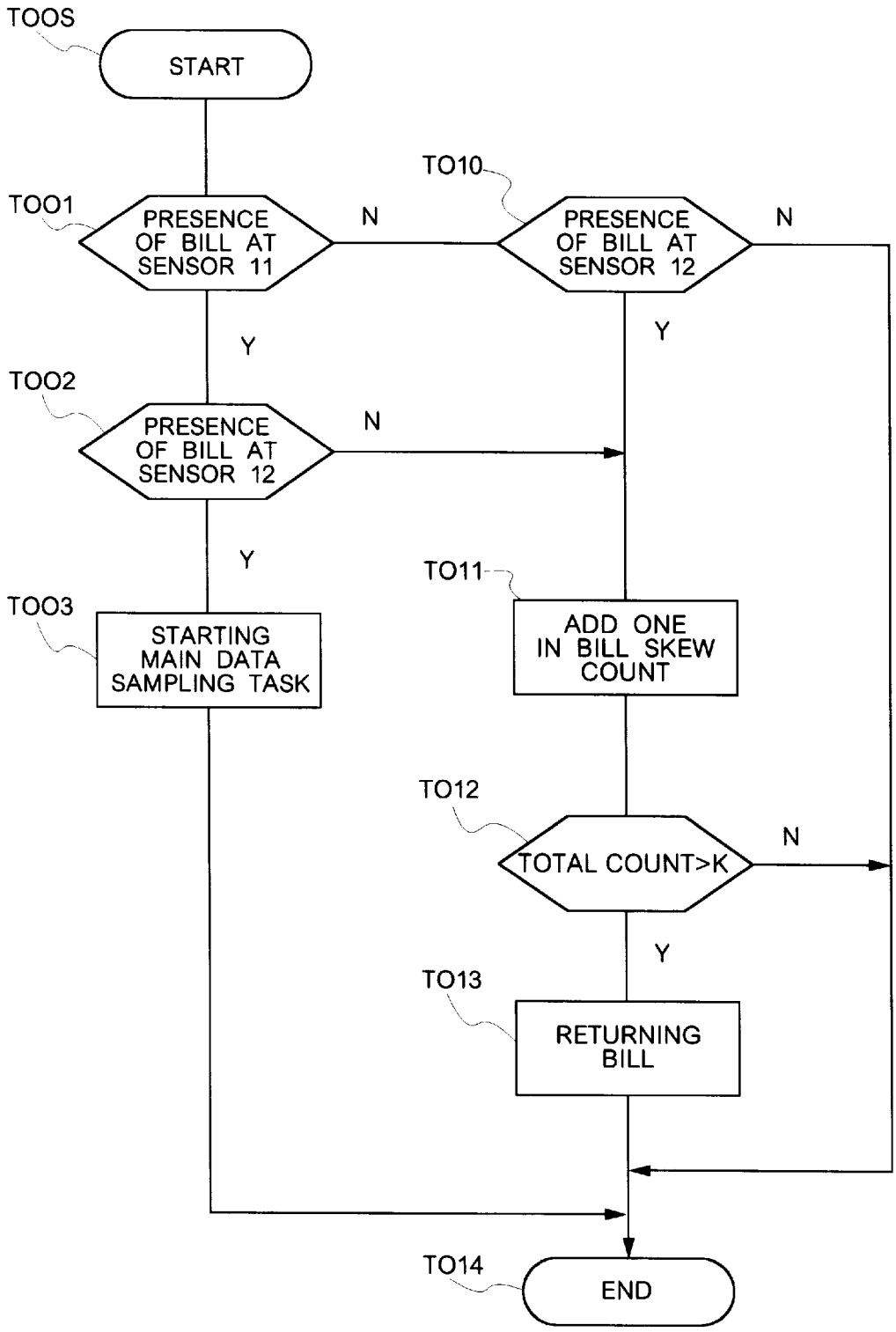
FIG. 5 is a flow chart to explain a part of the function for detecting a skewed bill by the apparatus shown in FIGS. 1, 2.

FIG. 5 is a flow chart that will help explain a substantial part of the function for detecting a skewed bill in the apparatus 1.

Now, the function of the apparatus 1 for detecting a skewed bill will be explained in reference to FIGS. 1, 2, 3, 4A–4K and 5.

As the bill 3 is inserted to the apparatus 1 through the inlet port 2, the sensor 10 detects the presence of the bill 3 to cause the bi-directional motor 9 to be driven in the normal rotating direction, so that the bill 3 is transported inwardly on the transport belts 5 that are driven by the motor 9. At this stage, the skewed bill detecting task indicated by the flow chart in FIG. 5 will start. This task will be explained in detail later.

It is assumed that the leading edge 3*e* of the bill 3 is angled with respect to the line 11*i*, as shown in FIG. 1, and the leading edge 3*e* reaches the sensor 11 before reaching the sensor 12. The output 41 of the sensor 11 will first fall at time $T_1$, when the leading edge 3*e* reaches the sensor 11, as shown in FIG. 4A. When the leading edge 3*e* reaches the sensor 12 the output 42 of the sensor 12 will also fall at time $T_2$, as shown in FIG. 4B. Provided that the bill has advanced at a constant speed between $T_1$ and $T_2$, the elapsed time from $T_1$ to $T_2$ represents a horizontal tilt angle of the leading edge 3*e* with respect to the imaginary line 11*i* that is orthogonal to the bill transport direction Bt because the bill sensors 11 and 12 are fixedly disposed, spaced apart from each other, on the line 11*i*. By measuring the time difference $T_2-T_1$, the tilt angle of the leading edge 3*e* is calculated from a known bill transport speed and the distance between the sensors 11 and 12. This is a part of the principle of the present invention.

Referring to FIGS. 2, 3 and 4A–4K, the analog outputs 41 and 42 of the sensors 11 and 12, respectively, are inputted to the first and the second AD converters 21 and 22, respectively. The levels of the outputs 41 and 42 represent the light intensities received by the light receivers 11*r* and 12*r*, respectively. The levels of the outputs 41 and 42 abruptly fall at $T_1$ and $T_2$, respectively, signifying that the leading edge 3*e* of the bill 3 reaches the sensors 11 and 12, respectively, at $T_1$ and $T_2$, respectively, and the bill 3 is present at the sensors 11 and 12, respectively, thereafter. The CPU 25 transmits through its output port 32 a sampling signal 43 to both the AD converters 21 and 22 in parallel so that the AD converters 21 and 22 continually transmit the first and the second digital value outputs 47 and 48, respectively, to the CPU 25 through its input ports 33 and 34, respectively. The numerals and/or alphabetical characters written in FIGS. 4G and 4H are hexadecimal numbers that represent light intensities received by the light receivers 11*r* and 12*r*, respectively. The hexadecimal number "FF" represents a saturated light intensity which occurs when no part of the bill 3 is present at the sensor 11 or 12. The AD converters 21 and 22 also transmit AD conversion completion signals 44 and 45, respectively, to the AND gate 23. The AND gate 23 transmits each pulse of the interrupt signal 46 to the CPU 25 through its input port 35 each time both pulses of the AD conversion completion signals 44 and 45 are input to the AND gate 23. The sampling signal 43 inputted to the AD converters 21, 22 are continual pulses having a 150 $\mu$s time period in the present embodiment and the time period is regulated by the timing signal generator 24 through the CPU 25. Accordingly, the AD conversion completion signals 44, 45 and the interrupt signal 46 are continual pulses having a 150 $\mu$s time period as well. The time interval indicated by "$t_{AD}$" in FIG. 4C signifies the time needed for the AD converters 21, 22 to complete AD conversions.

The task diagram 51 of FIG. 4K represents tasks performed by the CPU 25. A substantial task performed by the CPU 25 is a data sampling task 51*m* for identifying and verifying the bill 3. But upon receiving the interrupt signal 46, the task 51*m* is interrupted and CPU 25 performs a subroutine task, i.e. a skewed bill detecting task 51*s*, to determine whether or not the bill 3 is skewed. It takes about 12 $\mu$s for the CPU 25 to complete one sequence of the skewed bill detecting task 51*s* after each input of the interrupt signal 46, in the present embodiment.

FIG. 5 is a flow chart to explain the skewed bill detecting task 51*s* performed in the CPU 25. Referring to FIGS. 4E–4K and 5, the input of the interrupt signal 46 to the CPU 25 causes the CPU 25 to start the task 51*s* (T00S). The first digital value output 47 is compared with a predetermined value, such as a value "AA" in hexadecimal system. If the output 47 is smaller than "AA", it is determined that the leading edge 3*e* has reached the sensor 11 and the bill 3 is present thereat (T001). Likewise, the second digital value output 48 is compared with the same predetermined value "AA", and if the output 48 is smaller than "AA", it is determined that the leading edge 3*e* has reached the sensor 12 and the bill 3 is present thereat (T002). If the output 47 or 48 is not smaller than the value "AA", it is determined that the leading edge 3*e* has not reached the sensor 11 or 12, respectively. When it is determined that leading edge 3*e* has reached both the sensors 11 and 12, the bill 3 is not considered to be skewed and the main data sampling task 51*m* for identifying and verifying the bill 3 will restart (T003) and the bill 3 will be accepted by the apparatus 1 provided that no discrepancy is found in the main data sampling task (T003), and the skewed bill detecting task 51*s* will end (T014).

If it is determined that the leading edge 3*e* has not reached the sensor 11 (T001) but reached the sensor 12 (T010), or, if the leading edge 3*e* has reached the sensor 11 (T001) but not the sensor 12 (T002), the CPU 25 will start a "BILL SKEW COUNT" (T011) with a first count one (1). One (1) count is added to this counting (T011) each time the interrupt signal 46 enters the CUP 25 and the sequence of the skewed bill detecting task 51*s*, as shown in the flow chart of FIG. 5, is repeated, provided that the leading edge 3*e* has reached only one of the two sensors 11 and 12, but not the both. In each sequence of the skewed bill detecting task 51*s*, the total number n (FIG. 4I) counted in "BILL SKEW COUNT" (T011) will be compared with a predetermined number K, and if the total counted number n is greater than K (T012), it is determined that the bill 3 is skewed and the CPU 25 will transmit the motor reverse signal 50 (FIG. 4J) to the motor controller 27 to cause the rotational direction of the motor 9 to be reversed, whereby the bill 3 will be returned through the bill inlet port 2 (T013).

As mentioned above, the time period of the interrupt signal 46 (FIG. 4E) inputted to the CPU 25 is 150 $\mu$sec. The cycle period of the skewed bill detecting task 51*s* is, therefore, 150 $\mu$sec as well. The criterion number K, in the present embodiment, is sixty (60). The bill 3 is, therefore, determined to be skewed if the time difference between $T_1$ and $T_2$ is greater than 9.0 msec (150 $\mu$sec×60). The actual distance between the bill sensors 11 and 12 is 31 mm. It is designed that the bill 3 is transported in the bill transport path 4 at a speed of 180 mm/sec. The bill 3, therefore, travels a distance of 1.62 mm (180 mm×0.009 sec) in 9 msec. Thus, the bill 3 is determined to be skewed if the leading edge 3*e* is angled more than about 3° ($\tan^{-1}$ 1.62/31) with respect to the imaginary line 11*i* (FIG.1).

The non-saturated portions of the outputs of the sensors 11 and 12 after $T_1$ and $T_2$, respectively, as shown in FIG. 4A and 4B, respectively, signify print densities of parts of the bill 3 that are scanned and read by the respective sensors. If the leading edge 3*e* has reached both the sensors 11 and 12 within the time difference of 9.0 msec, whereby the bill 3 is not determined to be skewed, these non-saturated outputs are analyzed in the CPU 25 in order to identify and verify the bill 3 as the main task 51*m*. Since the function for identifying and verifying the bill 3 per se is not a main object of the present invention, as already mentioned above, no detail explanation of this function will be made. One unique element of the present invention, however, is that the sensors 11, 12, which are utilized for identifying and verifying the bill 3 are also utilized to detect any bill in a skewed state.

Effects of the Present Invention

In the task of determining whether or not the bill 3 is skewed in the present invention, the judgment is made within a very short time (9 msec) after the leading edge 3*e* of the bill 3 reaches either of the bill sensor 11 or 12. The judgment can be made without waiting until the trailing edge of the bill 3 reaches the bill sensor 10, as opposed to the case in the prior art referred to above. This means that any bill inserted to the apparatus 1 in a skewed state can be returned within a short time after the bill is inserted to the apparatus 1 before the skewed bill is further transported in the apparatus 1. A chance of jamming of the bill in the apparatus 1 is, therefore, minimized.

Furthermore, since any skewed bill can be detected within a very short time after the insertion of the bill to the apparatus 1, there will be little chance that the detection of a skewed bill is adversely affected by any fluctuation of power source voltage, any change of ambient temperature, or any increased frictional loss in the transport mechanism, which may be caused by aging of the mechanism and may adversely affect accuracy of the measurement of the time difference between $T_1$ and $T_2$.

In addition, since the time difference between $T_1$ and $T_2$ is compared with a predetermined criterion time value and the judgment of any skew of the bill is determined by a digital arithmetic operation in the CPU 25 according to the program stored in the program memory (ROM) 26 (FIG. 3), the maximum allowable skew, which is the critical tilt angle of the leading edge of the bill, can be adjusted by only changing the program, if necessary, without modifying the hardware.

Light reflection type photo-electronic sensors may be substituted for the sensors 11 and 12, instead of the ones of light transmission type used in the present embodiment. In this case, output signal patterns of the sensors will be substantially different. The program in the program memory 26 must, therefore, also be different.

It should also be understood that various changes and modifications may be made in the above described embodiments which provide the characteristics of the present invention without departing from the spirit and principle thereof particularly as defined in the following claims.

What is claimed is:

1. An automatic bill accepting apparatus that can detects a skewed bill inserted thereto, comprising:

(a) a bill transport path so that a bill is transported therein;

(b) a first photo-electronic sensor that outputs a first analog signal;

(c) a second photo-electronic sensor that outputs a second analog signal, said first sensor and said second sensor being disposed in said bill transport path spaced apart from each other on a line that is orthogonal to a bill transport direction;

(d) a first AD converter for converting said first analog signal to a first series of digital values at a predetermined sampling frequency;

(e) a second AD converter for converting said second analog signal to a second series of digital values at said predetermined sampling frequency;

(f) means for comparing sequentially each of said first series of digital values with a predetermined digital value;

(g) means for comparing sequentially each of said second series of digital values with said predetermined digital value;

(h) means for determining a first time when any of said first series of digital values is smaller than said predetermined digital value;

(i) means for determining a second time when any of said second series of digital values is smaller than said predetermined digital value;

(j) means for obtaining a CPU interrupt signal each time when each of said first series of digital values and each of said second series of are transmitted from said first AD converter and said second AD converter, respectively;

(k) means for counting a number of said interrupt signal between said first time and said second time;

(l) means for comparing said counted number of said interrupt signal with a predetermined number; and (m) means for determining that the bill is skewed if said counted number of said interrupt signal is greater than a predetermined number.

2. An automatic bill accepting apparatus that can detects a skewed bill inserted thereto, comprising:

(a) a bill transport path so that a bill is transported therein;

(b) a first photo-electronic sensor that outputs a first analog signal, said first sensor being adapted for scanning a leading edge of the bill being transported;

(c) a second photo-electronic sensor that outputs a second analog signal, said second sensor being adapted for scanning said leading edge of said bill being transported, said first sensor and said second sensor being adapted for being utilized for identifying and verifying the bill and disposed in said bill transport path spaced apart from each other on a line that is orthogonal to a bill transport direction;

(d) a first AD converter for converting said first analog signal to a first digital signal at a predetermined sampling frequency, said first digital signal signifying a series of first digital values varying at said sampling frequency, said first AD converter also outputting a first AD conversion completion signal each time AD conversion to each of said first digital values is completed;

(e) a second AD converter for converting said second analog signal to a second digital signal at said predetermined sampling frequency, said digital signal signifying a series of second digital values varying at said sampling frequency, said second AD converter outputting a second AD conversion completion signal each time AD conversion to each of said second digital values is completed;

(f) means for comparing sequentially each of said first digital values with a predetermined value;

(g) means for comparing sequentially each of said second digital values with said predetermined value;

(h) means for determining a first time when any of said first digital values is smaller than said predetermined value;

(i) means for determining a second time when any of said second digital values is smaller than said predetermined value;

(j) means for obtaining an interrupt signal each time said first AD converter completes AD conversion, thereby outputting said first AD conversion completion signal, and said second AD converter completes AD conversion, thereby outputting said second AD conversion completion signal, said interrupt signal interrupting a main task performed in a CPU;

(k) means for counting a number of said interrupt signal between said first time and said second time;

(l) means for comparing said counted number of said interrupt signal with a predetermined number;

(m) means for determining that the bill is skewed if said counted number of said interrupt signal is greater than said predetermined number; and (n) means for transmitting a bill transport motor reverse signal when the bill is determined to be skewed.

3. An automatic bill accepting apparatus that can detects a skewed bill inserted thereto, comprising:

(a) a bill transport path so that a bill is transported therein;

(b) a first photo-electronic sensor;

(c) a second photo-electronic sensor, said first sensor and said second sensor being disposed in said bill transport path spaced apart from each other on a line that is orthogonal to a bill transport direction;

(d) means for determining a first time when said first sensor detects a leading edge of said bill;

(e) means for determining a second time when said second sensor detects said leading edge;

(f) means for determining a time difference between said first time and said second time;

(g) means for comparing said time difference with a predetermined value;

(h) means for determining that the bill is skewed if said time difference is greater than said predetermined value;

(i) a first AD converter for converting an output of said first sensor to digital values at a predetermined sampling frequency;

(j) a second AD converter for converting an output of said second sensor to digital values at said predetermined sampling frequency;

(k) means for counting a number of completion of AD conversions by both of said first and second AD converters; and (l) means for converting said counted number of completion of AD conversions to said time difference between said first time and said second time.

* * * * *